US008213816B2

(12) United States Patent
Kozitsky et al.

(10) Patent No.: US 8,213,816 B2
(45) Date of Patent: Jul. 3, 2012

(54) METHOD AND SYSTEM FOR BANDING COMPENSATION USING ELECTROSTATIC VOLTMETER BASED SENSING

(75) Inventors: Vladimir Kozitsky, Rochester, NY (US); Peter Paul, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 399 days.

(21) Appl. No.: 12/549,095

(22) Filed: Aug. 27, 2009

(65) Prior Publication Data

US 2011/0052228 A1 Mar. 3, 2011

(51) Int. Cl.
*G03G 15/00* (2006.01)

(52) U.S. Cl. ..... 399/48; 399/49; 399/66; 399/15

(58) Field of Classification Search ..... 399/48, 399/49, 53, 66, 15

See application file for complete search history.

(56) References Cited

U.S. PATENT DOCUMENTS

| | | | |
|---|---|---|---|
| 4,400,740 | A | 8/1983 | Traino et al. |
| 4,786,858 | A | 11/1988 | Haas et al. |
| 5,119,131 | A | 6/1992 | Paolini et al. |
| 5,165,074 | A | 11/1992 | Melino |
| 5,251,058 | A | 10/1993 | MacArther |
| 5,270,660 | A | 12/1993 | Werner, Jr. et al. |
| 5,321,476 | A | 6/1994 | Gross |
| 5,438,354 | A | 8/1995 | Genovese |
| 5,519,514 | A | 5/1996 | TeWinkle |
| 5,550,653 | A | 8/1996 | TeWinkle |
| 5,659,414 | A | 8/1997 | Appel et al. |
| 5,680,541 | A | 10/1997 | Kurosu et al. |
| 5,818,507 | A | 10/1998 | Genovese |
| 6,342,963 | B1 | 1/2002 | Yoshino |
| 6,359,641 | B1 | 3/2002 | Nacman et al. |
| 6,462,821 | B1 | 10/2002 | Borton et al. |
| 6,567,170 | B2 | 5/2003 | Tandon et al. |
| 6,621,576 | B2 | 9/2003 | Tandon et al. |
| 6,760,056 | B2 | 7/2004 | Klassen et al. |
| 6,771,912 | B1 | 8/2004 | Mo et al. |
| 6,806,717 | B2 | 10/2004 | Werner, Jr. et al. |
| 6,975,949 | B2 | 12/2005 | Mestha et al. |
| 7,024,152 | B2 | 4/2006 | Lofthus et al. |
| 7,038,816 | B2 | 5/2006 | Klassen et al. |
| 7,054,568 | B2 | 5/2006 | Mizes et al. |
| 7,058,325 | B2 | 6/2006 | Hamby et al. |
| 7,136,616 | B2 | 11/2006 | Mandel et al. |
| 7,177,585 | B2 | 2/2007 | Matsuzaka et al. |
| 7,400,339 | B2 * | 7/2008 | Sampath et al. ..... 347/251 |

(Continued)

*Primary Examiner* — David Gray
*Assistant Examiner* — G. M. Hyder
(74) *Attorney, Agent, or Firm* — Pillsbury Winthrop Shaw Pittman LLP

(57) ABSTRACT

A method and system for compensating for an image quality defect in an image printing system comprising at least one marking station, the at least one marking station comprising a charging device for charging the image bearing surface, an exposing device for irradiating and discharging the image bearing surface to form a latent image, a developer unit for developing toner to the image bearing surface, and a transfer unit for transferring toner from the image bearing surface to an image accumulation surface is provided. The method includes sensing the image quality defect on an image bearing surface by an electrostatic voltmeter (ESV) in the image printing system and determining the frequency, amplitude, and/or phase of the image quality defect by a processor. In one embodiment, the method includes compensating for the image quality defect by modulating the power of an exposing device during an expose process. In another embodiment, the method includes compensating for the image quality defect by modifying image content.

35 Claims, 7 Drawing Sheets

U.S. PATENT DOCUMENTS

| | | | | |
|---|---|---|---|---|
| 7,492,381 | B2 | 2/2009 | Mizes et al. | |
| 2003/0063183 | A1 | 4/2003 | AuYeung et al. | |
| 2006/0077488 | A1 | 4/2006 | Zhang et al. | |
| 2006/0077489 | A1 | 4/2006 | Zhang et al. | |
| 2006/0140655 | A1* | 6/2006 | Fasen | 399/55 |
| 2007/0052991 | A1 | 3/2007 | Goodman et al. | |
| 2007/0139733 | A1 | 6/2007 | Mizes et al. | |
| 2007/0236747 | A1 | 10/2007 | Paul | |
| 2009/0002724 | A1 | 1/2009 | Paul et al. | |

* cited by examiner

METHOD AND SYSTEM FOR BANDING COMPENSATION USING ELECTROSTATIC VOLTMETER BASED SENSING

FIELD

The present disclosure relates to a method and system for compensating for image quality defects using an Electrostatic Voltmeter (ESV).

BACKGROUND

An electrophotographic, or xerographic, image printing system employs an image bearing surface, such as a photoreceptor drum or belt, which is charged to a substantially uniform potential so as to sensitize the surface thereof. The charged portion of the image bearing surface is exposed to a light image of an original document being reproduced. Exposure of the charged image bearing surface selectively dissipates the charge thereon in the irradiated areas to record an electrostatic latent image on the image bearing surface corresponding to the image contained within the original document. The location of the electrical charge forming the latent image is usually optically controlled. More specifically, in a digital xerographic system, the formation of the latent image is controlled by a raster output scanning device, usually a laser or LED source.

After the electrostatic latent image is recorded on the image bearing surface, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the image bearing surface. After the electrostatic latent image is developed with the toner particles, the toner powder image is transferred to a media, such as sheets, paper or other substrate sheets, using pressure and heat to fuse the toner image to the media to form a print.

The image printing system generally has two important dimensions: a process (or a slow scan) direction and a cross-process (or a fast scan) direction. The direction in which an image bearing surface moves is referred to as the process (or the slow scan) direction, and the direction perpendicular to the process (or the slow scan) direction is referred to as the cross-process (or the fast scan) direction.

Electrophotographic image printing systems of this type may produce color prints using a plurality of stations. Each station has a charging device for charging the image bearing surface, an exposing device for selectively illuminating the charged portions of the image bearing surface to record an electrostatic latent image thereon, and a developer unit for developing the electrostatic latent image with toner particles. Each developer unit deposits different color toner particles on the respective electrostatic latent image. The images are developed, at least partially in superimposed registration with one another, to form a multi-color toner powder image. The resultant multi-color powder image is subsequently transferred to a media. The transferred multicolor image is then permanently fused to the media forming the color print.

Banding generally refers to periodic defects on an image caused by a one-dimensional density variation in the process (slow scan) direction. An example of this kind of image quality defect, periodic banding, is illustrated in FIG. 1. As shown in FIG. 1, bands exist in columns 1*a*, 1*b*, 1*c*, 1*d*, 1*e*, 1*f* and 1*g*. Banding in a xerographic engine may be caused by charge non-uniformity on the image bearing surface, variations in a Photo Induced Discharge Curve (PIDC), image bearing surface motion quality variations, and/or image bearing surface "out-of-round" that lead to periodic non-uniformities manifesting in the output print. The PIDC may be defined as a plot of surface potential of the image bearing surface as a function of incident light exposure. For an example of a system and method for generating a PIDC, see U.S. Pat. No. 6,771,912, herein incorporated by reference in its entirety. Image bearing surface motion quality variation may be defined as imperfections in the motion of the image bearing surface causing the instantaneous position of the image bearing surface to be less than ideal. Image bearing surface motion quality variations may be caused by vibration, motion backlash, gear train interactions, mechanical imbalances, friction, among other factors. Image bearing surface out-of-round may be defined as variations in the diameter of the image bearing surface, such as a photoreceptor drum, causing the image bearing surface to not be perfectly round. These problems can exist at build, or through degradation with component age. Costly part replacement has been used in the past to counteract these problems.

Several different methods and systems exist for measuring image quality defects. These methods and systems usually use sensors in the form of densitometers, including Automatic Density Control (ADC) sensors, to measure image quality defects in an output print. Generally, a densitometer measures the degree of darkness for an image. In particular, an ADC sensor may measure the light reflected from the toner image on an intermediate transfer belt, and supplies a voltage value corresponding to the measured amount of light to a controller. The problem with an ADC reading is that sources of noise due to development, first transfer, and retransfer on downstream image bearing surfaces are introduced, therefore decreasing the signal-to-noise ratio (SNR).

SUMMARY

According to one aspect of the present disclosure, a method for compensating for an image quality defect in an image printing system comprising at least one marking engine, the at least one marking station comprising a charging device for charging the image bearing surface, an exposing device for irradiating and discharging the image bearing surface to form a latent image, a developer unit for developing toner to the image bearing surface, and a transfer unit for transferring toner from the image bearing surface to an image accumulation surface is provided. The method includes sensing the image quality defect on an image bearing surface by an electrostatic voltmeter (ESV) in the image printing system; determining the frequency, amplitude, and/or phase of the image quality defect by a processor; and compensating for the image quality defect by modulating the power of the exposing device during an expose process.

According to another aspect of the present disclosure, a method for compensating for an image quality defect in an image printing system comprising at least one marking station comprising a charging device for charging the image bearing surface, an exposing device for irradiating and discharging the image bearing surface to form a latent image, a developer unit for developing toner to the image bearing surface, and a transfer unit for transferring toner from the image bearing surface to an image accumulation surface is provided. The method includes sensing the image quality defect on an image bearing surface by an electrostatic voltmeter (ESV) in the image printing system; determining the frequency, amplitude, and/or phase of the image quality defect by a processor; and compensating for the image quality defect by modifying image content.

According to another aspect of the present disclosure, a system for compensating for an image quality defect in an image printing system is provided. The system includes a marking engine; an electrostatic voltmeter (ESV) configured to sense the image quality defect on an image bearing surface; a processor, wherein the processor is configured to determine the frequency, amplitude, and/or phase of the banding defect based on readings of the ESV; and a controller, wherein the controller is configured to compensate for the image quality defect by modulating power of the exposing device during an expose process.

According to another aspect of the present disclosure, a system for compensating for an image quality defect in an image printing system is provided. The system includes a marking engine; an electrostatic voltmeter (ESV) configured to sense the image quality defect on an image bearing surface; a processor, wherein the processor is configured to determine the frequency, amplitude, and/or phase of the banding defect based on readings of the ESV; and a controller, wherein the controller is configured to compensate for the image quality defect by modifying image content.

BRIEF DESCRIPTION OF THE DRAWINGS

Various embodiments will now be disclosed, by way of example only, with reference to the accompanying schematic drawings in which corresponding reference symbols indicate corresponding parts, in which.

DETAILED DESCRIPTION

The present disclosure addresses an issue in the area of banding correction. The present disclosure proposes a use of Electrostatic Voltmeter (ESV) sensors to measure charge density variation, or voltage non-uniformity, on the image bearing surface to sense periodic image quality defects. Image quality defects, such as banding defects, may be caused by charge non-uniformity, variations in the Photo Induced Discharge Curve (PIDC), image bearing surface motion quality variations, and/or image bearing surface "out-of-round." The present disclosure proposes compensating for the image quality defects by generating a compensation signal. In one embodiment, the compensation signal may modulate power of an exposing device, such as a Raster Output Scanner (ROS), during the expose process. In another embodiment, the compensation signal may modify image content. Such an embodiment may have a marking engine with an image bearing surface that is synchronous with the printed pages such that each page starts at substantially the same point on the image bearing surface circumference. ESV sensors may yield a less noisy signal because fewer noise sources contribute to its signal as compared to ADC sensors, thus requiring fewer test patch measurements and reducing the time required for banding compensation.

Figure 2:
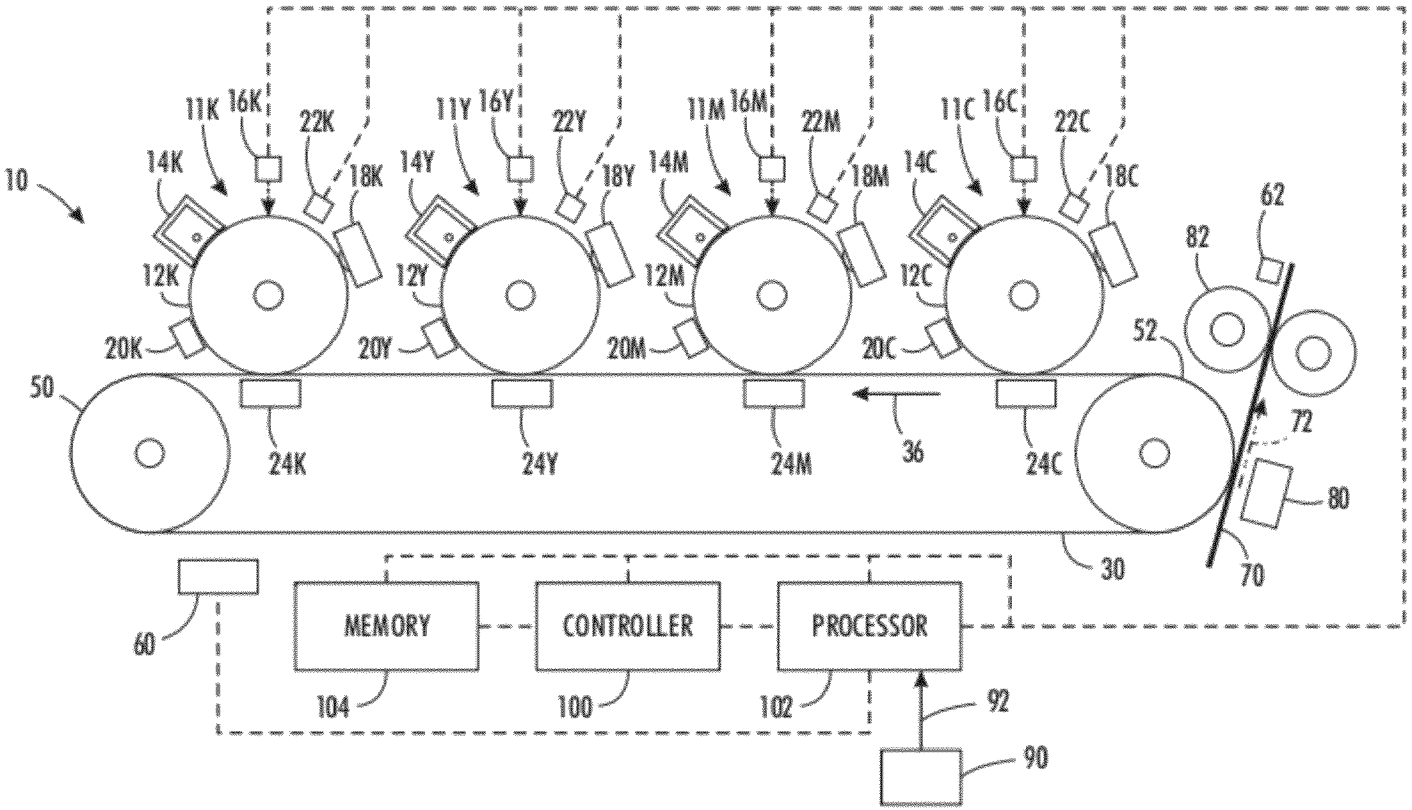
FIG. 2 illustrates an image printing system employing ESV based sensing to compensate for image quality defects.

FIG. 2 illustrates one embodiment of a multicolor image printing system 10 incorporating an embodiment. One embodiment may be the Xerox DocuColor 8000®. Specifically, there is shown an "intermediate-belt-transfer" xerographic color image printing system, in which successive primary-color (e.g., C, M, Y, K) images are accumulated on image bearing surface 12C, 12M, 12Y, and 12K. Each image bearing surface 12C, 12M, 12Y, and 12K in turn transfers the images to an intermediate transfer member 30. However, it should be appreciated that any image printing machine, such as monochrome machines using any technology, machines that print on photosensitive substrates, xerographic machines with multiple photoreceptors, "image-on-image" xerographic color image printing systems (e.g., U.S. Pat. No. 7,177,585, herein incorporated by reference in its entirety), Tightly Integrated Parallel Printing (TIPP) systems (e.g. U.S. Pat. Nos. 7,024,152 and 7,136,616, each of which herein incorporated by reference in its entirety), or liquid ink electrophotographic machines, may utilize the present disclosure as well.

Figure 1:
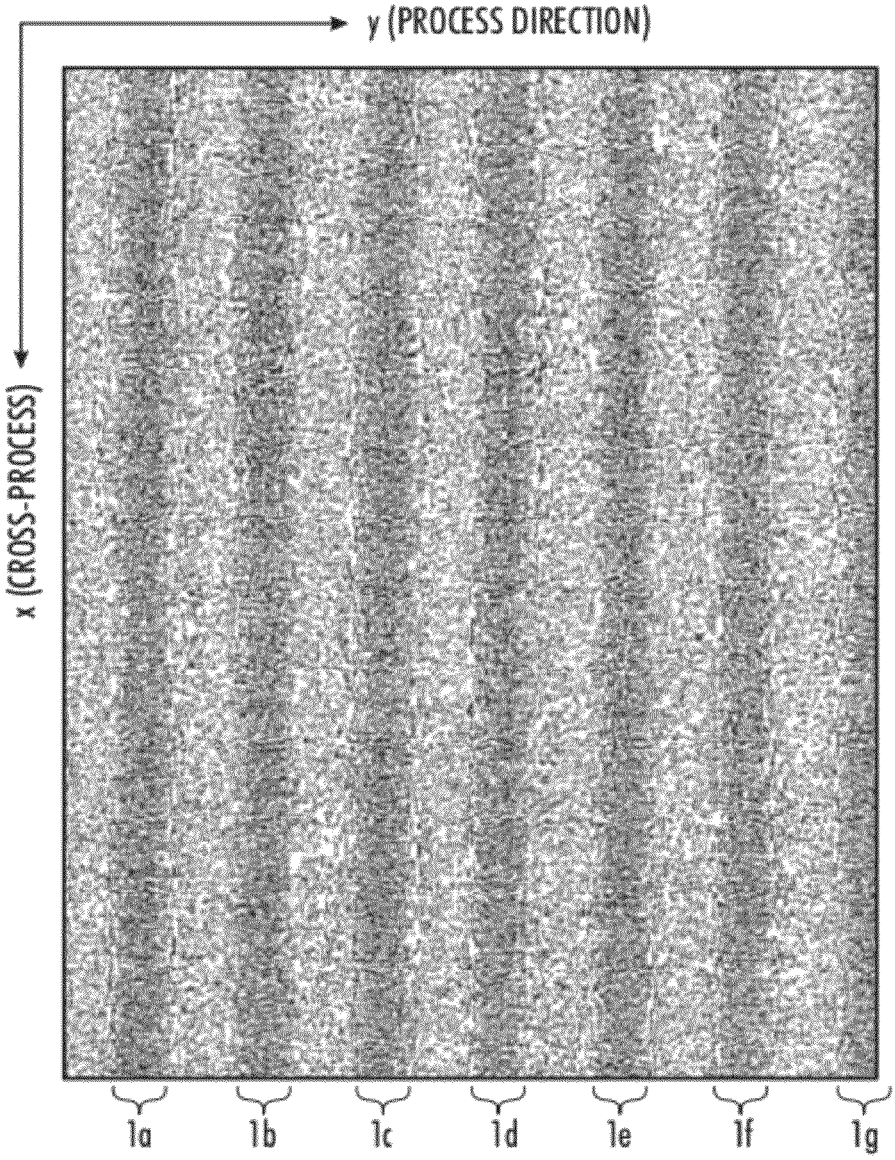
FIG. 1 illustrates banding in the process direction.

In an embodiment, the image printing system 10 includes marking stations 11C, 11M, 11Y, and 11K (collectively referred to as 11) arranged in series for successive color separations (e.g., C, M, Y, and K). Each print station 11 includes an image bearing surface with a charging device, an exposing device, a developer device, an ESV and a cleaning device disposed around its periphery. For example, printing station 11C includes image bearing surface 12C, charging device 14C, exposing device 16C, developer device 18C, ESV 22C, transfer device 24C, and cleaning device 20C. Transfer device 24C may be a Bias Transfer Roll, as shown in FIG. 1 of U.S. Pat. No. 5,321,476, herein incorporated by reference in its entirety. For successive color separations, there is provided equivalent elements 11M, 12M, 14M, 16M, 18M, 20M, 22M, 24M (for magenta), 11Y, 12Y, 14Y, 16Y, 18Y, 20Y, 22Y, 24Y (for yellow), and 11K, 12K, 14K, 16K, 18K, 20K, 22K, 24K (for black).

In one embodiment, a single color toner image formed on first image bearing surface 12C is transferred to intermediate transfer member 30 by first transfer device 24C. Intermediate transfer member 30 is wrapped around rollers 50, 52 which are driven to move intermediate transfer member 30 in the direction of arrow 36. The successive color separations are built up in a superimposed manner on the surface of the intermediate transfer member 30, and then the image is transferred from the intermediate transfer member (e.g., at transfer station 80) to an image accumulation surface 70, such as a document, to form a printed image on the document. The image is then fused to document 70 by fuser 82.

The exposing devices 16C, 16M, 16Y, and 16K may be one or more Raster Output Scanner (ROS) to expose the charged portions of the image bearing surface 12C, 12M, 12Y, and 12K to record an electrostatic latent image on the image bearing surface 12C, 12M, 12Y, and 12K. U.S. Pat. No. 5,438,354, the entirety of which is incorporated herein by reference, provides one example of a ROS system.

In one aspect of the embodiment, ESVs 22C, 22M, 22Y, and 22K (collectively referred to as 22) are configured to sense a charge density variation, or voltage non-uniformity, on the surface of image bearing surfaces 12C, 12M, 12Y, and 12K, (collectively referred to as 12) respectively. For examples of ESVs, see, e.g., U.S. Pat. Nos. 6,806,717, 5,270,660; 5,119,131; and 4,786,858, each of which herein incorporated by reference in its entirety. Preferably, ESVs 22C, 22M, 22Y, and 22K are located after exposing devices 16C, 16M, 16Y, and 16K, respectively, and before developer devices 18C, 18M, 18Y, and 18K, respectively. It should be appreciated that an array of ESVs may be arranged in the cross-process direction to enable measurement of banding amplitude variation across the cross-process direction. This would be particularly beneficial in a synchronous photoreceptor embodiment using the digital image data as the actuator. It should also be appreciated that multiple ESVs may be mounted around the photoreceptor to enable decomposition of the banding defects by source. For example, an ESV mounted post-charge and pre-exposure would enable measurement of charge induced banding, and an ESV mounted post-expose and pre-development would further enable measurement of photoreceptor motion and PIDC induced banding. For embodiments that employ multiple ESVs mounted around the photoreceptor, the same charged-and-exposed area on the photoreceptor may be measured by multiple ESVs.

In another aspect of the embodiment, ESVs 22 may be used in conjunction with sensors 60 and/or 62. Sensor 60 may be a densitometer configured to measure toner density variation on the intermediate transfer member 30 and provide feedback (e.g., reflectance of an image in the process and/or cross-process direction) to processor 102. Sensor 60 may be an Automatic Density Control (ADC) sensor. For an example of an ADC sensor, see, e.g., U.S. Pat. No. 5,680,541, which is incorporated herein by reference in its entirety. Sensor 62 is configured to sense images created in the output prints, including paper prints, and provide feedback (e.g., reflectance of an image in the process and/or cross-process direction) to processor 102. Sensor 62 may be a Full Width Array (FWA) or Enhanced Toner Area Coverage (ETAC). See, e.g., U.S. Pat. Nos. 6,975,949 and 6,462,821, each of which herein incorporated by reference in its entirety, for an example of a FWA sensor and an example of a ETAC sensor, respectively. Sensors 60 and 62 may include a spectrophotometer, color sensors, or color sensing systems. For example, see, e.g., U.S. Pat. Nos. 6,567,170; 6,621,576; 5,519,514; and 5,550,653, each of which herein is incorporated by reference in its entirety.

The readings of ESVs 22 are sent to the processor 102. Processor 102 is configured to align location, such as patch number, to the readings, or signals, of ESVs 22 to generate ESV signatures (shown in FIG. 5 and FIG. 6 for example) representing the particular post-exposure charge density variation, or voltage non-uniformity, of image bearing surfaces 12. Processor 102 is also configured to generate data relating to the frequency, amplitude, and/or phase of bands based on the charge density or voltage readings of ESVs 22. See U.S. Patent Pub. Nos. 2009/0002724 and 2007/0236747, each of which herein incorporated by reference in its entirety, for examples of systems and methods for measuring the frequency, amplitude, and/or phase of banding print defects. Processor 102 also may be configured to generate data relating to the image reflectance profiles sensed by sensors 60 and 62. The data generated by processor 102 may be stored in memory 104.

The data relating to the frequency, amplitude, and/or phase of the image quality defects may be received by controller 100 from processor 102. The controller 100 compensates for the image quality defects based the data received from processor 102. The controller 100 may compensate for the bands by employing various methods and actuators. In one embodiment, controller 100 may modulate the power, or intensity, of exposing devices 16C, 16M, 16Y, and 16K during the expose processes. For examples of methods and systems for modulating expose processes, see, e.g., U.S. Pat. Nos. 7,492,381, 6,359,641, 5,818,507, 5,659,414, 5,251,058, 5,165,074 and 4,400,740 and U.S. Patent Application Pub. No. 2003/0063183, each of which herein incorporated by reference in its entirety.

In another embodiment, controller 100 may compensate for the image quality defects by digitally modifying the input image data content, such as the area coverage or raster input level. This may be used for engines whose image bearing surface may be synchronous with the printed pages. Controller 100 may be configured to determine and apply a correction value for each pixel. The correction value applied to each pixel depends on both the input value for the pixel and the location of the pixel. For instance, the location may correspond to the row or column address of the pixel.

Referring back to FIG. 2, processor 102 may be an image processing system (IPS) that may incorporate what is known in the art as a digital frond end (DFE). For example, processor 102 may receive image data representing an image to be printed. The processor 102 may process the received image data to produce print ready data that is supplied to an output device, such as marking engines 11C, 11M, 11Y and 11K. Processor 102 may receive image data 92 from an input device (e.g., an input scanner) 90, which captures an image from an original document, a computer, a network, or any similar or equivalent image input terminal in communication with processor 102.

Figure 3:
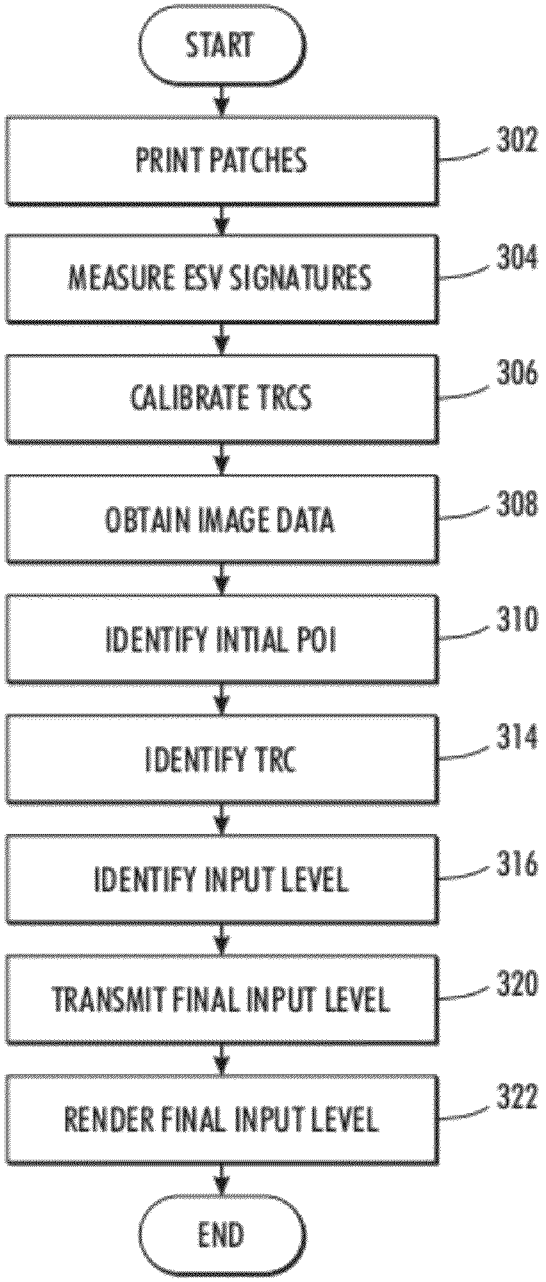
FIG. 3 illustrates one embodiment of a method for digitally modifying the image content data employing ESV based sensing to compensate for image quality defects.

FIG. 3 illustrates one embodiment of a method for digitally modifying the input image data content to compensate for bands using readings from ESVs. First, in step 302, patches of different area coverages are printed. For example, the patches may be one-page for each of 2%, 5%, 10%, 15%, 20%, etc., up to 100% area coverage. The different area coverages may represent different raster input levels. The patches may be at the inboard and/or outboard side of image bearing surfaces 12 (shown in FIG. 2), depending on the location of ESVs 22. Second, in step 304, ESV signatures are measured based on the readings of ESVs 22 (shown in FIG. 2), for example, for the different area coverages.

In one embodiment, ESV readings may be averaged along a non-correctable direction, such as the cross-process direction when correcting for banding. ESV readings from multiple print runs may be averaged to measure an ESV signature. This gives a mapping from location to ESV signature as a function of respective positions along a correctable direction, such as the process direction, on the page. A sensitivity function between actuator and sensed quantity may be obtained. For example, a measurement of ESV change with a change in exposure may be performed by simply writing two patches at the same area coverage, but at two different exposure levels, then reading the ESV change between the two patches. This generates a sensitivity slope which may be used with the ESV signature to generate an exposure signature that will correct the banding. Sensitivity may be determined for all the area coverage levels used. In an alternate embodiment, where the actuator is the digital image, a similar sensitivity function is measured by writing two patches at slightly different area coverage levels and measuring the ESV difference between the patches to generate the sensitivity slope. Again, the sensitivity function may be determined for all area coverage levels used.

Figure 4:
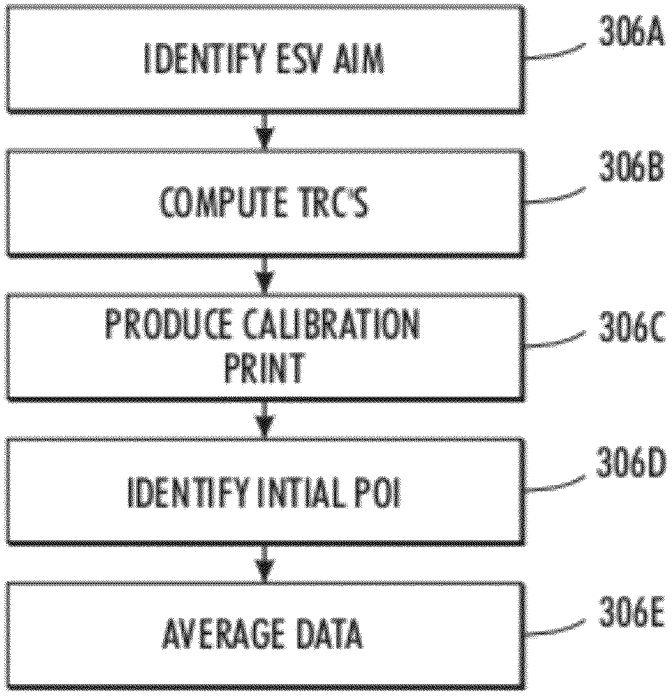
FIG. 4 illustrates one embodiment of a method of calibrating tone reproduction curves (TRCs) in accordance with an embodiment.

Third, in step 306, tone reproduction curves (TRCs) are calibrated. The step 306 of calibrating the TRCs is described in detail with reference to FIG. 4. In a step 306A, an ESV aim is identified. The ESV aim may be defined as: (1) the average of each ESV signature, or (2) a value at a fixed location along each signature, or (3) a calibration with an optical measurement, by sensors 60 or 62 for example, on belt or on paper, or (4) a fixed specified value for each area coverage. It is contemplated that other values may be used as ESV aims. Controller 100 (shown in FIG. 2), for example, may be configured to determine the ESV aim. Controller 100 may be programmed at build to digitally modify the image data content according to a particular ESV aim.

TRCs are computed in a step 306B. The TRCs may be computed by processor 102 for example. A curve representing Area Coverage versus ESV signal at each location along an ESV signature may be used to determine the appropriate area coverage that results in the desired ESV aim value for each location along the signature for each input area coverage. The newly defined spatially varying TRC curve may be applied to images as they are printed.

In a step 306C, a calibration print of constant area coverage, which corresponds to an ESV aim value, is produced by one or more marking stations 11. Controller 100 (shown in FIG. 2), for example, may initiate the calibration print. ESVs, such as 22 (shown in FIG. 2) for example, can detect the charge density, or voltage, of image bearing surfaces, such as image bearing surfaces 12 (shown in FIG. 2) for example, associated with the calibration print. The processor 102 (shown in FIG. 2) begins processing the ESV signature representative of the calibration page by identifying, in a step 306D, an initial position (pixel) within the ESV signature as a current position (pixel of interest (POI)) to be processed. Then, in a step 306E, the processor 102 (shown in FIG. 2) averages the ESV readings at the current POI of the calibration page over a non-correctable direction of the one or more marking engines 11. For example, if the output produced by the one or more marking stations 11 may be corrected in the process direction, the ESV readings may be averaged over the cross-process direction. This process may be repeated for other constant area coverage levels. The steps 306A-E may be repeated for each pixel along the correctable direction of the image printing system 10.

Referring back to FIG. 3, after the TRCs are calibrated, control passes to a step 308 for obtaining image data of an image 92 (shown in FIG. 2) to be produced using the one or more marking stations 11. Processor 102 (shown in FIG. 2) may be configured to obtain image data of image 92 (shown in FIG. 2). Once the image data is obtained, a first pixel is identified, in a step 310, by controller 100, for example, as a current POI within the image data.

The coordinate (e.g., the y-coordinate), which represents the dimension capable of being corrected, of the position (x,y) of the current POI is used as a key for identifying, in a step 314, one of the TRC identifiers within the look-up table. Then, a area coverage input level is determined, in a step 316, by controller 100 (shown in FIG. 2), for example, as a function of the TRC identifier and the correctable dimension of the position of the current POI. For example, the input level is identified as a parameter of the TRC according to I(i,j)=TRC [O(i,j); i,j], where I(i,j) represents the input level and O(i,j) represents the original digital image value at the position (i,j). It should be appreciated that while I(i,j) references a TRC based on an input pixel value and the current spatial location, the location could possess a two-dimensional spatial dependence or could be one-dimensional to correct for one-dimensional problems (e.g., bands). In another embodiment, the input level is identified in the step 316 as a function of I(i,j) =TRC[O(i,j); C(i,j)], where C(i,j) is a classifier identified as a function of the position (i,j). Since a compensation signal may fall into a very small number of classes (e.g., sixteen (16)), the operation may be indexed by a number less than the number of spatial locations.

In the step 320, the final area coverage input level is transmitted to one or more of marking stations 11 (shown in FIG. 2). Then, in a step 322, the final area coverage input level is rendered on an output medium, such as image bearing surfaces 12 (shown in FIG. 2), as an area coverage output level by the marking stations 11 (shown in FIG. 2). For more details on digitally modifying input image data content, see, e.g., U.S. Pat. Nos. 7,038,816 and 6,760,056, each of which herein incorporated by reference in its entirety. See also U.S. Patent Application Pub. Nos. 2006/0077488, 2006/0077489, and 2007/0139733, each of which herein incorporated by reference in its entirety.

Referring back to FIG. 1, the bands shown in columns 1*a*, 1*b*, 1*c*, 1*d*, 1*e*, 1*f*, and 1*g* may be for a full page constant 50% area coverage test patch, for example. The bands shown in columns 1*a*, 1*b*, 1*c*, 1*d*, 1*e*, 1*f*, and 1*g* may be caused by a mechanical defect that results in printed regions that appear darker than the nominal printed regions. Controller 100 (shown in FIG. 2) may compensate for the image quality defects by using the processes disclosed in FIGS. 3 and 4 and applying correction values for the pixels in columns 1*a*, 1*b*, 1*c*, 1*d*, 1*f*, and 1*g*, for example, such that only a 45% area coverage is printed in columns 1*a*, 1*b*, 1*c*, 1*d*, 1*f*, and 1*g*, thus reducing the darkness of those regions to that of the nominal regions and consequently decreasing the presence of image quality defects.

In an alternate embodiment, the controller 100 may adjust development device(s) 18 to reduce the development of toner to image bearing surface(s) 22 when making ESV measurements. This can be accomplished by setting the developer bias voltage to a magnitude less than that of exposed image bearing surface(s) 22. By doing so, the toner used during the ESV measurement may be reduced.

In another alternate embodiment, the controller may adjust transfer device(s) 24 to reduce the transfer of toner to the intermediate transfer member 30 when making ESV measurements. This can be accomplished by reducing the transfer device current or voltage to a low magnitude. The toner on image bearing surface(s) 12 does not transfer to the intermediate transfer member 30, and is then cleaned to a waste container by cleaning device(s) 20 on image bearing surface(s) 12. By doing so, contamination of the second transfer device is reduced and the stress on the cleaning device on the intermediate belt is also reduced, increasing its life.

Figure 5:
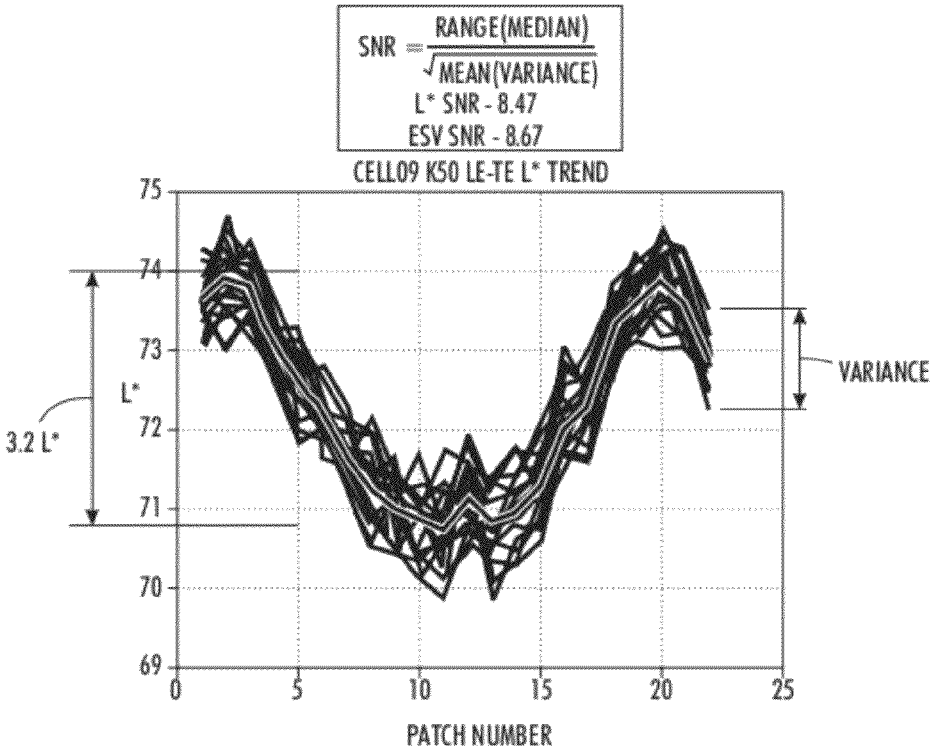
FIG. 5 illustrates an image reflectance profile sensed by a sensor, with an equation for measuring the corresponding signal-to-noise ratio.

FIG. 5 illustrates an example of a banding signal sensed by sensor 62 (L*). A signal-to-noise ratio metric (SNR), as described on the top of FIG. 5, is a metric to quantify the ability of sensors to sense the banding signal. The signal is defined to be the median banding amplitude, and the noise is the standard deviation of the resulting signal when removing the median banding amplitude.

Figure 6:
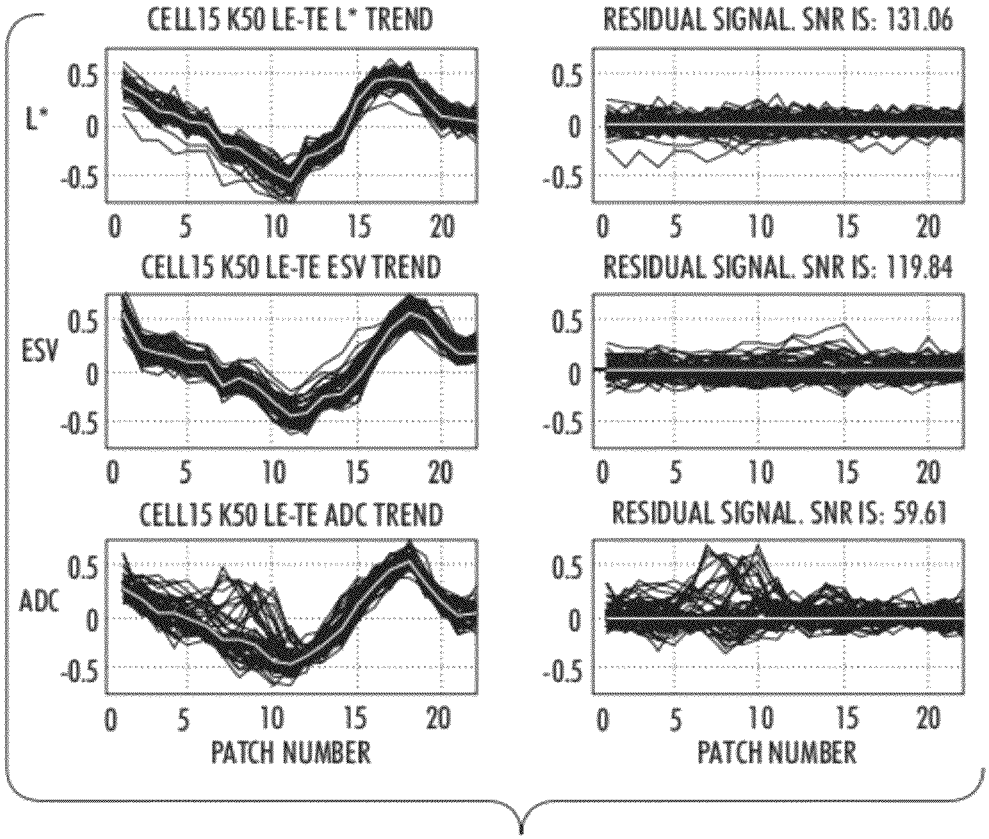
FIG. 6 illustrates normalized signals sensed by a sensor sensing the output print, an ESV sensor, and an ADC sensor, an the corresponding signal-to-noise ratios.

FIG. 6 shows the signal-to-noise ratio metric applied to the L* data from sensor 62, the ADC data from sensor 60, and the ESV data from sensor 22C, for example. The left side of FIG. 6 shows real test data, while the right side shows projections of the signal-to-noise ratio for each of the sensor readings. The three data sets were normalized for comparison. The ESV signal-to-noise ratio is almost two times larger than that of the ADC. ESV sensors can be "more noisy" than ADC sensors. However, for banding due to charging or PIDC variation, image bearing surface motion quality variation, and image bearing surface "out of round," the ESV may yield a less noisy signal because fewer noise sources contribute to its signal than to that of the ADC. The ADC signal is composed of additional noises due to development, first transfer, and retransfer on downstream image bearing surfaces, while the ESV is not subject to these noise sources. Better signal-to-noise ratio means that a control loop that uses an ESV as a feedback source to compensate for image bearing surface related banding can use fewer patch measurements than an ADC for the equivalent SNR. This results in less time for interrupting jobs for "adjusting print quality," faster cycle-up convergence, less customer impact, and improved productivity for the printing system. This would result in a roughly two times reduction in the number of patches used for the ESV based compensation system relative to the ADC based compensation system.

In addition to improved SNR, by using the ESV for measurements, patches from each color separation can lie on top of each other on the intermediate belt, since they are measured individually on each individual image bearing surface (a separate image bearing surface is used for each color separation in the intermediate belt architecture). Because they can all lie on top of each other on the intermediate belt, a four times improvement in "lost productivity," or number of patches printed, due to banding compensation may be achieved. Combined with the SNR effect, the ESV based banding compensation system may achieve an effective eight times improvement in lost productivity for banding reduction, relative to a banding compensation system based on ADC sensor measurements. This results in less time for interrupting jobs for "adjusting print quality," faster cycle-up convergence, less customer impact, and improved productivity for the printing system—while improving the image quality of the printing system.

The right side of FIG. 6 illustrates the estimated performance of banding compensation using sensor 62 (L*) as feedback, using the ESV as feedback, and using the ADC sensor as feedback. ESV feedback performs almost as well as L* feedback in terms of SNR, without the drawback of using paper and interrupting the customer job.

Figure 7:
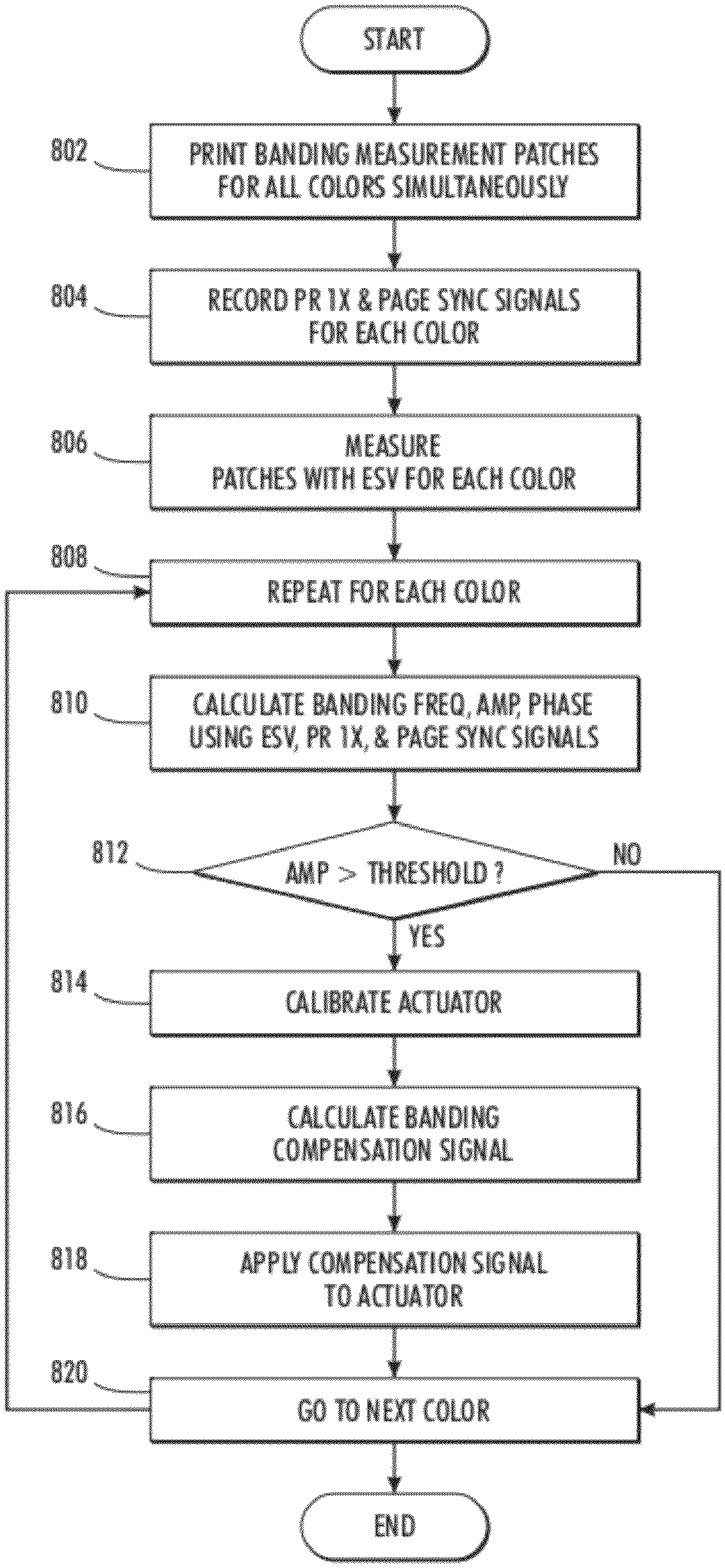
FIG. 7 illustrates one embodiment of a method for compensating for a banding defect using ESV based sensing.

FIG. 7 illustrates one embodiment of a method for banding compensation using ESVs. In process step 802, banding measurement patches are printed for all colors simultaneously. For example, the banding measurement patches may be full page single separation uniform halftone 11"×17" pages broken up into twenty-two 10 mm patches for measurement. In step 804, the photoreceptor once-around and page synchronization signals are recorded for each color. The photoreceptor once-around may indicate the beginning and end of one photoreceptor cycle, wherein a cycle begins and ends at the same point on the photoreceptor. The photoreceptor once-around signal may be generated by a optical sensor or encoder mounted on the rotating shaft of the photoreceptor drum, as is well known in the art. The page synchronization signal may indicate the leading beginning and end of a page of an output image. The page synchronization signal may be a signal internally generated by controller 100 (shown in FIG. 2), for example, as is well known in the art. See U.S. Pat. No. 6,342,963, FIGS. 13A and 13B and corresponding discussion, herein incorporated by reference in its entirety, for examples of page synchronization signals. In step 806, the patches are measured with an ESV for each color. The ESV measures the charge density variation, or voltage non-uniformity, for the patches for each color. In step 810, the banding frequency, amplitude, and phase of the banding defect(s) is calculated, by processor 102, for example, using the photoreceptor once-around, page synchronization signals, and charge density measurements by the ESV. The banding frequency, amplitude, and phase of the banding defect(s) may be calculated based on the timing information associated with the photoreceptor once-around signal, page synchronization signal, and charge density measurements by the ESV. For examples of systems and method for determining the frequency, amplitude, and phase of banding defects, see, e.g., U.S. Patent Application Nos. 2007/0052991, 2007/0236747, and 2009/0002724, each of which herein incorporated by reference in its entirety. In step 812, the amplitude of the bands are compared to a threshold level. If the amplitude is less than the threshold level, the controller proceeds to calculate the banding frequency, amplitude, and phase using the ESV for the next color through steps 820 and 808. If the amplitude of the bands is greater than the threshold level, in step 814 the controller calibrates the actuator. In step 816, the banding compensation signal is calculated. In step 818, the banding compensation signal is applied to the actuator, for example, to modulate the power of exposing device 16C (shown in FIG. 2) or digitally modify the image content (shown in FIGS. 3 and 4). In step 820 to 808 and 810, the banding frequency, amplitude, and phase is calculated for the next color using an ESV.

It should be appreciated that embodiments are applicable to TIPP systems, including Color TIPP systems. Such systems are known where multiple printers are controlled to output a single print job, as disclosed in U.S. Pat. Nos. 7,136,616 and 7,024,152, each of which herein is incorporated by reference in its entirety. In TIPP systems, each printer may have one or more ESVs associated with it to sense image quality defects. The controller may be configured to compensate for banding by adjusting the power of exposing devices in each printer. The controller may also be configured compensate for banding by modifying the image content printed by each printer.

It should be appreciated that for Color TIPP systems, banding requirements may be tighter than for single marking engine image printing systems. To illustrate for example, in a reproduction job where each page has the same image content, photoreceptor banding may not yield objectionable defects on a single marking engine image printing system that is photoreceptor synchronous (each page starts at the same point on the photoreceptor), because, for example, the lead edge, representing the starting edge of a band, of each print may be a bit "lighter" than desired and the trail edge, representing the trailing edge of a band, may be a bit "darker." Each page is consistent with the other pages. However, for the same job produced on a Color TIPP system, the same sheet is printed on by two or more constituent marking engines. One marking engine may have a photoreceptor banding yielding a "lighter" lead edge and a "darker" trail edge, while the other marking engine may a photoreceptor banding yielding a "darker" lead edge and a "lighter" trail edge. Therefore, the pages printed by the two engines would demonstrate significantly more objectionable banding.

It should be appreciated that embodiments may be employed in conjunction with a system and method for controlling a voltage of the image bearing surface, as disclosed in U.S. patent application Ser. No. 12/190,335, herein incorporated by reference in its entirety. For example, referring back to FIG. 2, controller 100 may modulate the current/voltage driven to a charging device 14C for bands caused by defects in marking engine 11C.

The word "image printing system" as used herein encompasses any device, such as a copier, bookmaking machine, facsimile machine, or a multi-function machine. In addition, the word "image printing system" may include ink jet, laser or other pure printers, which performs a print outputting function for any purpose.

While the present disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the present disclosure following, in general, the principles of the present disclosure and including such departures from the present disclosure as come within known or customary practice in the art to which the present disclosure pertains, and as may be applied to the essential features hereinbefore set forth and followed in the spirit and scope of the appended claims.

What we claim is:

1. A method for compensating for an image quality defect in an image printing system comprising at least one marking station, the at least one marking station comprising a charging device for charging an image bearing surface, an exposing device for irradiating and discharging the image bearing surface to form a latent image, a developer unit for developing toner to the image bearing surface, and a transfer unit for transferring toner from the image bearing surface to an image accumulation surface, the method comprising:

sensing the image quality defect on the image bearing surface using an electrostatic voltmeter (ESV) in the image printing system;

determining at least an amplitude of the image quality defect by a processor;

comparing the amplitude of the image quality defect to a predetermined threshold value; and compensating for the image quality defect by modulating a power of the exposing device during an expose process if the amplitude of the image quality defect is greater than the predetermined threshold value.

2. The method according to claim 1, wherein the ESV is located between the charging device and the developer unit.

3. The method according to claim 1, wherein the step of sensing the image quality defect further comprises printing test patches for each of a plurality of color separations, wherein the developer unit is adjusted so as to reduce the development of toner to the image bearing surface.

4. The method according to claim 3, wherein the step of determining at least the amplitude of the image quality defect further comprises:

receiving at least one photoreceptor once-around signal and page synchronization signal for each color separation; and using the at least one photoreceptor once-around signal and the page synchronization signal for each color separation to determine at least the amplitude of the image quality defect.

5. The method according to claim 3, wherein, if the amplitude of the image quality defect is less than the predetermined threshold value, the steps of determining and comparing are performed for a next color separation.

6. The method according to claim 3, further comprising performing the steps of determining and comparing for a next color separation, after the step of compensating is performed.

7. The method according to claim 1, wherein the step of sensing the image quality defect further comprises printing test patches for each of a plurality of color separations, wherein the transfer unit is adjusted so as to reduce the transferring of toner to the image accumulation surface.

8. The method according to claim 1, further comprising the step of compensating for the image quality defect by modulating a current and/or voltage driven by the charging device.

9. The method according to claim 1, wherein the step of determining further comprises determining a frequency and/or phase of the image quality defect by the processor.

10. A method for compensating for an image quality defect in an image printing system comprising at least one marking station, the at least one marking station comprising a charging device for charging an image bearing surface, an exposing device for irradiating and discharging the image bearing surface to form a latent image, a developer unit for developing toner to the image bearing surface, and a transfer unit for transferring toner from the image bearing surface to an image accumulation surface, the method comprising:

sensing the image quality defect on the image bearing surface using an electrostatic voltmeter (ESV) in the image printing system;

determining a frequency, amplitude, and/or phase of the image quality defect by a processor; and compensating for the image quality defect by modulating a power of the exposing device during an expose process, wherein the step of sensing the image quality defect further comprises printing test patches for each separation, wherein the test patches for each of a plurality of color separations overlie each other.

11. A method for compensating for an image quality defect in an image printing system comprising at least one marking station, the at least one marking station comprising a charging device for charging an image bearing surface, an exposing device for irradiating and discharging the image bearing surface to form a latent image, a developer unit for developing toner to the image bearing surface, and a transfer unit for transferring toner from the image bearing surface to an image accumulation surface, the method comprising:

sensing the image quality defect on the image bearing surface using an electrostatic voltmeter (ESV) in the image printing system;

determining a frequency, amplitude, and/or phase of the image quality defect by a processor; and compensating for the image quality defect by modulating a power of the exposing device during an expose process, wherein the step of determining the frequency, amplitude, and/or phase of the image quality defect by the processor further comprises receiving at least one photoreceptor once-around signal.

12. A method for compensating for an image quality defect in an image printing system comprising at least one marking station, the at least one marking station comprising a charging device for charging an image bearing surface, an exposing device for irradiating and discharging the image bearing surface to form a latent image, a developer unit for developing toner to the image bearing surface, and a transfer unit for transferring toner from the image bearing surface to an image accumulation surface, the method comprising: sensing the image quality defect on the image bearing surface using an electrostatic voltmeter (ESV) in the image printing system;

determining at least an amplitude of the image quality defect by a processor;

comparing the amplitude of the image quality defect to a predetermined threshold value; and compensating for the image quality defect by modifying image content if the amplitude of the image quality defect is greater than the predetermined threshold value.

13. The method according to claim 12, wherein the ESV is located between the charging device and the developer unit.

14. The method of claim 12, wherein the step of compensating for the image quality defect by modifying image content further comprises generating ESV signatures based on readings of the ESV.

15. The method according to claim 12, wherein the step of sensing the image quality defect further comprises printing test patches for each of a plurality of color separations, wherein the developer unit is adjusted so as to reduce the development of toner to the image bearing surface.

16. The method according to claim 12, wherein the step of sensing the image quality defect further comprises printing test patches for each of a plurality of color separations, wherein the transfer unit is adjusted so as to reduce the transferring of toner to the image accumulation surface.

17. The method according to claim 12, wherein the controller determines and applies a correction value based on both an input value for a pixel of interest and a row or column address of the pixel.

18. The method of claim 12, wherein the step of compensating for the image quality defect by modifying image content further comprises calibrating tone reproduction curves (TRCs) based on readings by the ESV.

19. The method according to claim 12, wherein the step of determining further comprises determining a frequency and/or phase of the image quality defect by the processor.

20. A method for compensating for an image quality defect in an image printing system comprising at least one marking station, the at least one marking station comprising a charging device for charging an image bearing surface, an exposing device for irradiating and discharging the image bearing surface to form a latent image, a developer unit for developing toner to the image bearing surface, and a transfer unit for transferring toner from the image bearing surface to an image accumulation surface, the method comprising: sensing the image quality defect on the image bearing surface using an electrostatic voltmeter (ESV) in the image printing system;

determining a frequency, amplitude, and/or phase of the image quality defect by a processor; and compensating for the image quality defect by modifying image content, wherein the step of sensing the image quality defect further comprises printing test patches for each of a plurality of color separations, wherein the test patches for each separation overlie each other.

21. A method for compensating for an image quality defect in an image printing system comprising at least one marking station, the at least one marking station comprising a charging device for charging an image bearing surface, an exposing device for irradiating and discharging the image bearing surface to form a latent image, a developer unit for developing toner to the image bearing surface, and a transfer unit for transferring toner from the image bearing surface to an image accumulation surface, the method comprising: sensing the image quality defect on the image bearing surface using an electrostatic voltmeter (ESV) in the image printing system;

determining a frequency, amplitude, and/or phase of the image quality defect by a processor; and compensating for the image quality defect by modifying image content, wherein the step of determining the frequency, amplitude, and/or phase of the image quality defect by the processor further comprises receiving at least one photoreceptor once-around signal.

22. A system for compensating for an image quality defect in an image printing system comprising:

a marking station, wherein the marking station includes an exposing device;

an electrostatic voltmeter (ESV) configured to sense the image quality defect on an image bearing surface;

a processor, wherein the processor is configured to:

determine at least an amplitude of the image quality defect based on readings of the ESV; and compare the amplitude of the image quality defect to a predetermined threshold value; and a controller, wherein the controller is configured to compensate for the image quality defect by modulating a power of the exposing device during an expose process if the amplitude of the image quality defect is greater than the predetermined threshold value.

23. The system according to claim 22, wherein the ESV is located between a charging device and a developing device.

24. The system according to claim 12, wherein the controller is further configured to compensate for the image quality defect by modulating a current and/or voltage driven by a charging device.

25. The system according to claim 22, wherein the processor is configured to also determine a frequency and/or phase of the image quality defect based on the reading of the ESVs.

26. A system for compensating for an image quality defect in an image printing system comprising:

a marking station, wherein the marking station includes an exposing device;

an electrostatic voltmeter (ESV) configured to sense the image quality defect on an image bearing surface;

a processor, wherein the processor is configured to determine a frequency, amplitude, and/or phase of the image quality defect based on readings of the ESV; and a controller, wherein the controller is configured to compensate for the image quality defect by modulating a power of the exposing device during an expose process, the marking station is configured to print test patches for each of a plurality of color separations, wherein the test patches for each separation overlie each other.

27. A system for compensating for an image quality defect in an image printing system comprising:

a marking station, wherein the marking station includes an exposing device;

an electrostatic voltmeter (ESV) configured to sense the image quality defect on an image bearing surface;

a processor, wherein the processor is configured to determine a frequency, amplitude, and/or phase of the image quality defect based on readings of the ESV; and a controller, wherein the controller is configured to compensate for the image quality defect by modulating a power of the exposing device during an expose process, wherein the controller is further configured to receive at least one photoreceptor once-around signal.

28. A system for compensating for an image quality defect in an image printing system comprising:

a marking station;

an electrostatic voltmeter (ESV) configured to sense the image quality defect on an image bearing surface;

a processor, wherein the processor is configured to:

determine at least an amplitude of the image quality defect based on readings of the ESV; and compare the amplitude of the image quality defect to a predetermined threshold value; and a controller, wherein the controller is configured to compensate for the image quality defect by modifying image content if the amplitude of the image quality defect is greater than the predetermined threshold value.

29. The system according to claim 28, wherein the ESV is located between a charging device and a developing device.

30. The system of claim 28, further comprising a processor configured to generate correction ESV signatures based on readings of the ESV, and transmit the correction ESV signatures to the controller.

31. The system according to claim 28, wherein the controller determines and applies a correction value based on both an input value for a pixel of interest and a row or column address of the pixel.

32. The system of claim 28, wherein the processor is configured calibrate tone reproduction curves (TRCs) based on readings by the ESV.

33. The system according to claim 28, wherein the processor is configured to also determine a frequency and/or phase of the image quality defect based on the reading of the ESVs.

34. A system for compensating for an image quality defect in an image printing system comprising:

a marking station; an electrostatic voltmeter (ESV) configured to sense the image quality defect on an image bearing surface;

a processor, wherein the processor is configured to determine a frequency, amplitude, and/or phase of the image quality defect based on readings of the ESV; and a controller, wherein the controller is configured to compensate for the image quality defect by modifying image content, wherein the marking station is configured to print test patches for each separation of a plurality of color separations, wherein the test patches for each separation, overlie each other.

35. A system for compensating for an image quality defect in an image printing system comprising:

a marking station;

an electrostatic voltmeter (ESV) configured to sense the image quality defect on an image bearing surface;

a processor, wherein the processor is configured to determine a frequency, amplitude, and/or phase of the image quality defect based on readings of the ESV; and a controller, wherein the controller is configured to compensate for the image quality defect by modifying image content, wherein the processor is further configured to receive at least one photoreceptor once-around signal.

* * * * *